US010066453B2

(12) United States Patent
Silva

(10) Patent No.: US 10,066,453 B2
(45) Date of Patent: Sep. 4, 2018

(54) SELF LOCKING PLUG SEAT, SYSTEM AND METHOD

(71) Applicant: Zachary S. Silva, Houston, TX (US)

(72) Inventor: Zachary S. Silva, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 291 days.

(21) Appl. No.: 14/952,898

(22) Filed: Nov. 25, 2015

(65) Prior Publication Data

US 2017/0145781 A1 May 25, 2017

(51) Int. Cl.
*E21B 23/06* (2006.01)
*E21B 33/134* (2006.01)

(52) U.S. Cl.
CPC ..... *E21B 23/06* (2013.01); *E21B 33/134* (2013.01)

(58) Field of Classification Search
CPC ..... E21B 23/01; E21B 23/06; E21B 33/129; E21B 33/134; E21B 34/14; E21B 19/10
See application file for complete search history.

(56) References Cited

U.S. PATENT DOCUMENTS

2010/0139911 A1* 6/2010 Stout ..... E21B 17/026 166/119
2013/0186616 A1* 7/2013 Xu ..... E21B 23/01 166/212
2013/0233535 A1* 9/2013 Pacey ..... E21B 34/14 166/206
2014/0060813 A1* 3/2014 Naedler ..... E21B 34/06 166/135
2014/0060834 A1 3/2014 Quintero et al.
2016/0186511 A1* 6/2016 Coronado ..... E21B 33/128 166/381

FOREIGN PATENT DOCUMENTS

WO 2012091984 A2 11/2012

OTHER PUBLICATIONS

"Ball and Seat Valve Solutions for Artificial Lift Systems—Designed to Outperform Oil & Gas Industry Requirements"; ITI Industrial Tectonics, Inc. brochure retreived from the internet May 30, 2017; www.ititball.com; 4 pages.
"Metal Seated McCannaSeal (R) Ball Valves"; FLOWSERVE Product Data Bulletin: 2011, 4 pages; www.flowserve.com.
Bal-tec Ball Check Valves, retrieved from the internet May 30, 2017; http://www.precisionballs.com/ball_valve.php, 25 pages.
Yuan, et al.; "Unlimited Multistage Frac Completion System; A revolutionary Ball-Activated System with Single Size Balls"; SPE 166303, SPE Annual Technical Conference & Exhibition, New Orleans, LA, USA; Sep. 30-Oct. 2, 2013; 9 pages.

* cited by examiner

*Primary Examiner* — Brad Harcourt
*Assistant Examiner* — David Carroll
(74) *Attorney, Agent, or Firm* — Cantor Colburn LLP

(57) ABSTRACT

A seat assembly includes a hollow frustocone; a slip subassembly interactive with the frustocone to anchor the frustocone in place during use. A seal disposed at the frustocone to receive a plug and upon receipt of the plug seal the plug to the frustocone and to a tubular structure in which the frustocone is anchored during use. A method for treating a borehole.

21 Claims, 5 Drawing Sheets

SELF LOCKING PLUG SEAT, SYSTEM AND METHOD

BACKGROUND

In industries concerned with subsurface operations in boreholes, there is often need for permanently or temporarily plugging off certain portions of a borehole system. One example relates to fracturing operations where a section of a borehole is isolated such that hydraulic pressure may be applied to that isolated area in order to fracture a formation surrounding the borehole in that location. For such operations it is common to land a plug on a seat in the borehole to effect the noted isolation. In some cases, seats for plugs are placed in the borehole at various times. Where these are placed prior to other operations or are left in place after the fracturing operation they may present an impediment to those other operations. Further, many prior art seat assemblies are complicated and dimensionally long. Accordingly, the art would well receive alternatives that overcome one or more of the foregoing drawbacks of the prior art.

SUMMARY

A seat assembly includes a hollow frustocone; a slip subassembly interactive with the frustocone to anchor the frustocone in place during use; a seal disposed at the frustocone to receive a plug and upon receipt of the plug seal the plug to the frustocone and to a tubular structure in which the frustocone is anchored during use.

A method for treating a borehole includes setting a seat assembly includes a hollow frustocone; a slip subassembly interactive with the frustocone to anchor the frustocone in place during use; a seal disposed at the frustocone to receive a plug and upon receipt of the plug seal the plug to the frustocone and to a tubular structure in which the frustocone is anchored during use in a tubular structure; landing a plug in the seat assembly; and hydraulically pressuring against the plug in the seat assembly.

BRIEF DESCRIPTION

The following descriptions should not be considered limiting in any way. With reference to the accompanying drawings, like elements are numbered alike:

DETAILED DESCRIPTION

Figure 1:
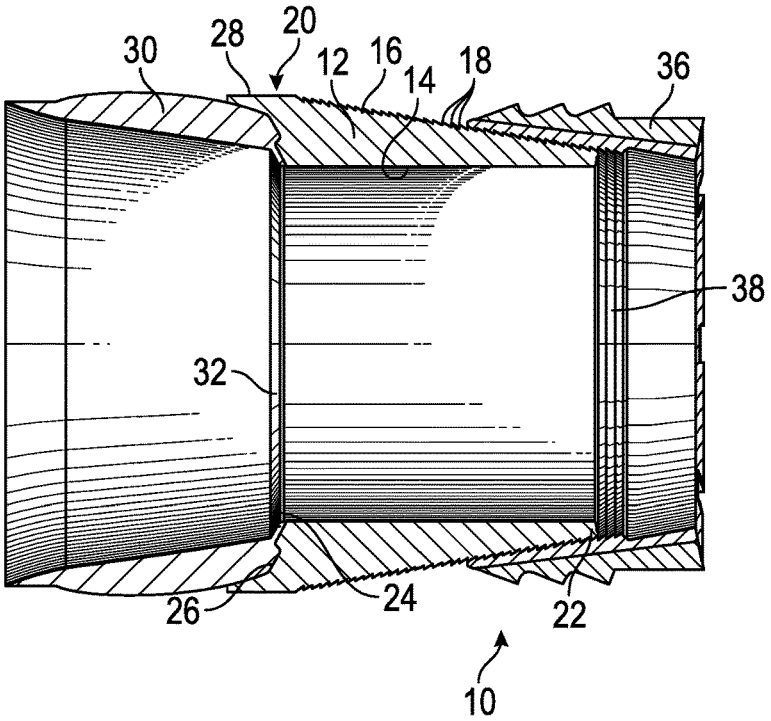
FIG. 1 is a cross sectional view of an embodiment of a seat assembly in accordance with the disclosure herein.

Referring to FIG. 1, an embodiment of the seat assembly 10 is illustrated. The seat assembly 10 comprises a frustocone 12 having an inside surface 14 and an outside surface 16. The outside surface in one embodiment includes wickers 18. The inside surface 14 and outside surface 16 in an embodiment have different frustoconical angles such that where the surfaces are joined by a seal end 20, a thickness of the frustocone is greater than at a narrow end 22. At seal end 20, the frustocone presents a seat 24 and a seal interconnection 26. Optionally a seal backup 28 may also be included.

Attached to the frustocone 12 is a seal 30. The seal 30 is attached to frustocone 12 at interconnection 26 by means of adhesive, bonding, press fit, etc. It is noted that in some embodiments the seal 30 will include a seat extension 32 overlaying seat 24 to enhance sealing of the seat assembly 10 during use.

In operable communication with the frustocone is a slip subassembly 36 that may be configured as a single slip or as a number of slips or as a slip ring that can expand or break apart as the slip assembly 36 is urged up the outer surface 16 of frustocone 12. Slip assembly 36 in some embodiments will include wicker threads 38 complementary to the wickers 18 on some embodiments of the frustocone 12.

The component disclosed together result in a much larger opening for flow through the seat assembly than prior art devices due to reduce components and redistributed functions.

Figure 2:
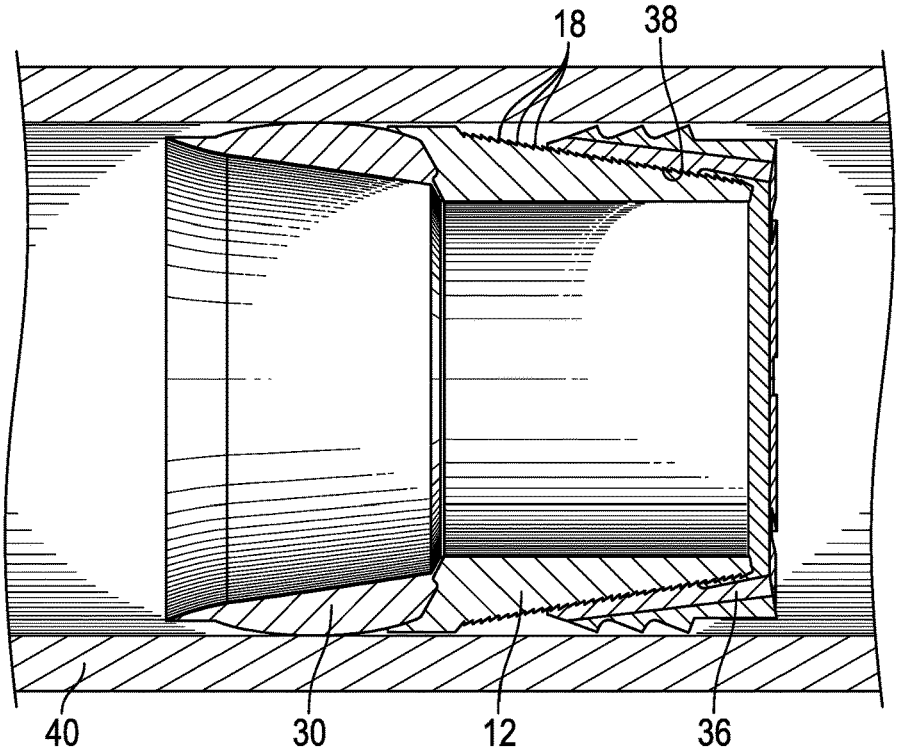
FIG. 2 is the embodiment of FIG. 1 illustrated in a set position in a tubular structure.

Referring now to FIG. 2, the seat assembly embodiment illustrated in FIG. 1 is illustrated in a set position in a tubular structure 40 such as a tubing string or casing string. It should be noticed that the slip assembly 36 has moved from the position illustrated in FIG. 1 to a position closer to the seal 30 in FIG. 2. This also means that the slip assembly 36 has been moved radially outwardly pursuant to the slip assembly 36 being located on the frustocone 12 at a part that has a larger diametric dimension. Radially outward motion of the slip assembly 36 will be familiar to one of ordinary skill and associated with the seat assembly being anchored in the tubular structure 40.

It is also to be appreciated that in the set position, seat assembly 10 positions the seal 30 close to the tubular structure 40 but not in contact therewith. Rather, contact and sealing is reserved for when a plug is landed in the seat assembly.

Figure 3:
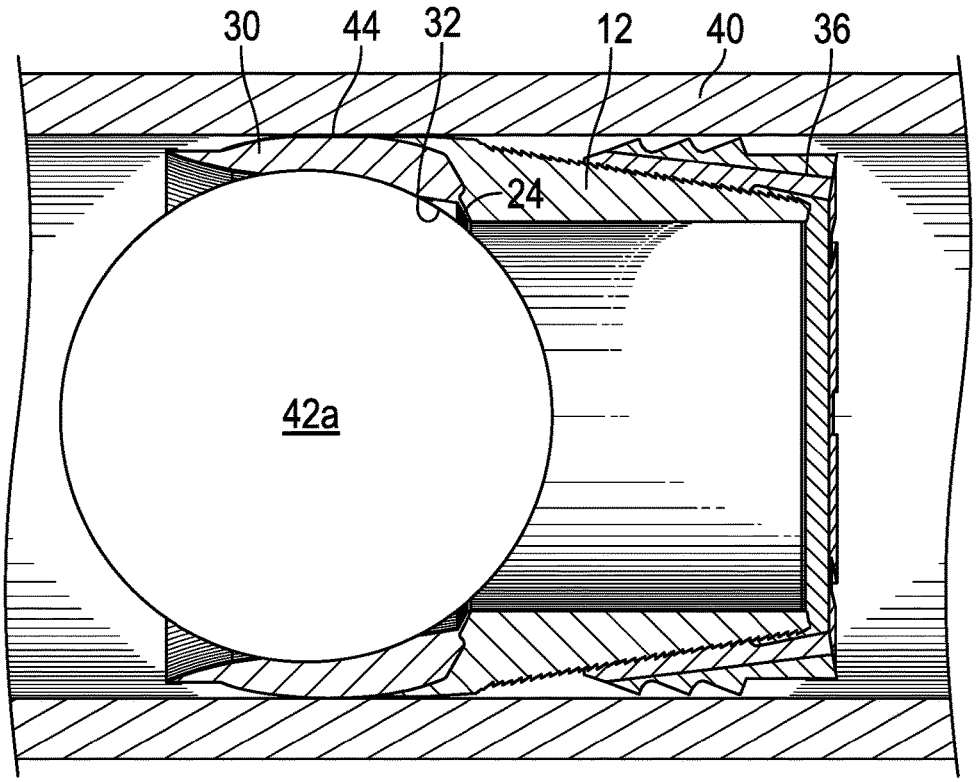
FIG. 3 is the embodiment of FIG. 2 with a ball seated in the seat assembly.
Figure 4:
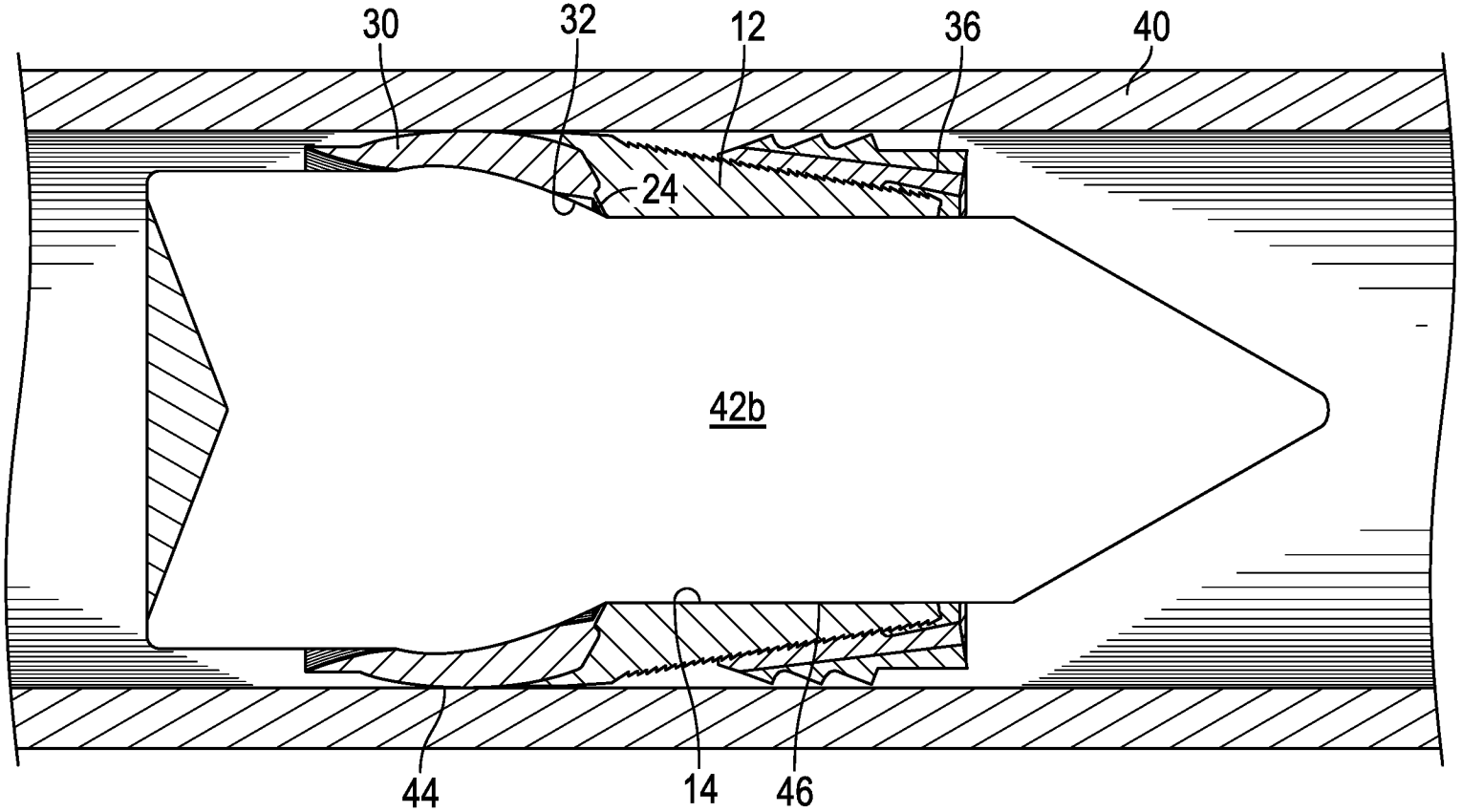
FIG. 4 is similar to the view of FIG. 3 but with a dart substituted for the ball.

Referring to FIGS. 3 and 4, the seat assembly 10 is illustrated again within the tubular structure 40 but now with a plug 42 (ball, dart, body, etc. each of which are contemplated to be degradable) in place. In FIG. 3 the plug is a ball and designated 42*a* and in FIG. 4 the plug is a body and is designated 42*b*. In each of these illustrated embodiments, the seal 30 has now been deformed into contact with the tubular structure 40. It is also possible to note that the seat extension 32 is lodged between the plug 42 and the seat 24 to effect a good seal between the plug 42 and the frustocone 12. This will prevent a leak path in this location while the contact at 44 between the seal 30 and the tubular structure 40 will prevent a leak path around the seat assembly 10.

It is also notable and worth consideration for particular operations using this seat assembly that in the FIG. 4 iteration, the frustocone 12 is supported at it's inside surface 14 by an outside surface 46 of the body 42*b*. This will increase the pressure rating of the assembly 10 and increase resistance to shifting of the seat assembly 10 within the tubular structure 40 after landing a plug 42. It is of course desirable to have the seat assembly 10 stay put after it is set.

Figure 5:
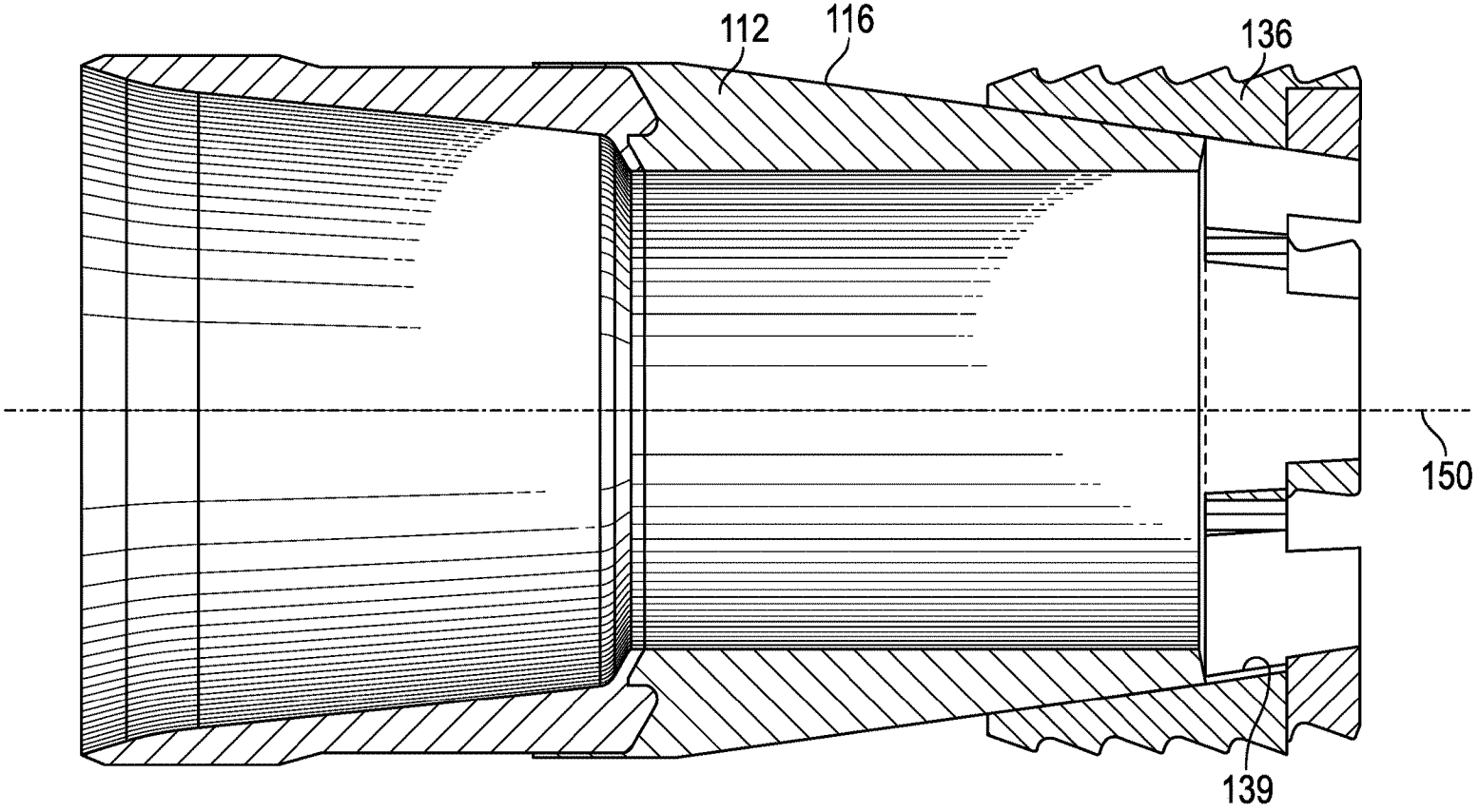
FIG. 5 is a cross sectional view of an alternate embodiment of the seat assembly in accordance with the disclosure herein.

Referring now to FIG. 5, it will be appreciated that much of the configuration of the embodiment of FIG. 1 remains the same. What is distinct about FIG. 5 is that the frustocone 112 does not include wickers 18 at all but rather is configured with a locking angle instead between it and the slip subassembly 136. It has been determined that an angle of less than seven degrees and greater than one degree of outside surface 116 of frustocone 112 will result in a locking engagement with a slip subassembly having a complementary angle at an inside surface 139 thereof when put under compressive load radially. Accordingly, when the slip subassembly 136 is forced into a tubular structure (e.g. 40 from previous figures) the radial load between the frustocone 112 and the structure will lock the slip subassembly 136 in place at angles ranging from 1 to 7 degrees relative to the axis 150 of the seat assembly 10.

It is noted that it is contemplated to form at least portions of the seat assembly 10 from a degradable material such as for example Intallic $^{tm}$ high strength degradable material available from Baker Hughes Incorporated, Houston Tex.

In order to set the seat assembly 10 as disclosed herein, the assembly is run to depth on a running tool common in the industry. Modifications to the common tool are discussed for clarity with reference to FIGS. 6-8 wherein a setting sequence is illustrated.

Figure 6:
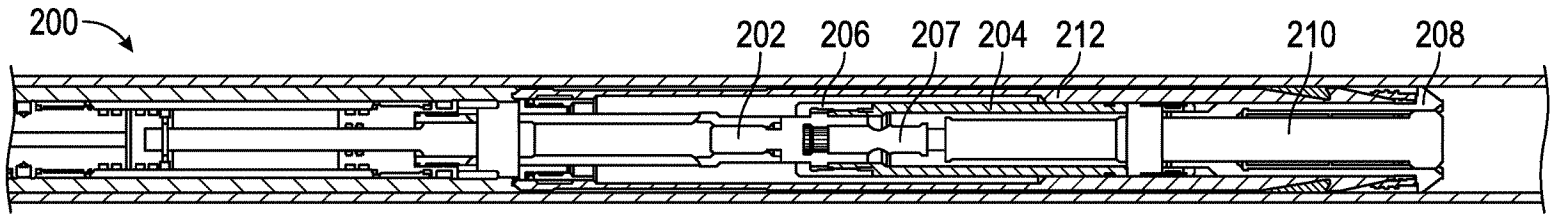
FIGS. 6-8 represent a sequence of installation of the seat assembly as disclosed herein.

Referring first to FIG. 6, the seat assembly is delivered to a target location with the running tool 200. Modification of the running tool for the purpose of the seat assembly disclosed herein begins at a tension mandrel 202 connected to a tension sleeve 204 through a jam nut 206. Within the tension mandrel 202 is a shear stud 207 (or other equivalent release member) whose function it is to release a tension collet 208 such that a support rod 210 may move out of a position where the tension collet 208 is supported by the support rod 210. A setting mandrel 212 is positioned against seat 24 of the seat assembly 10 and functions to resist movement of the seat assembly 10 while the tension collet is pulled to move the slip subassembly 36 up the frustocone 12.

Figure 7:
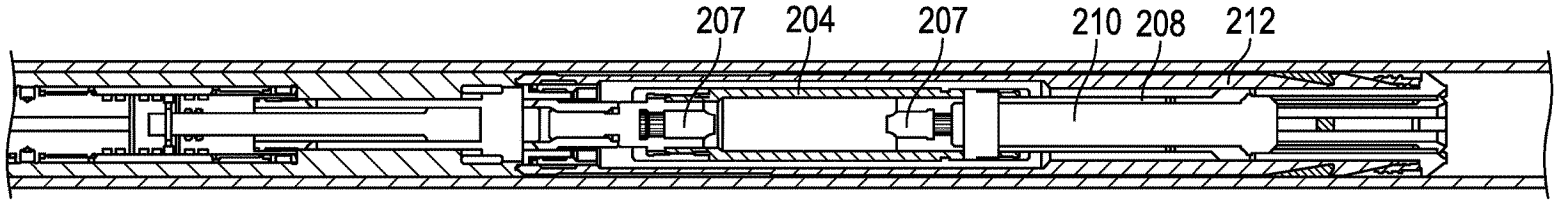

Referring to FIG. 7, when the appropriate selected tensile limit is reached, the shear stud 204 is parted resulting in the tension collet 208 being release from the source of tension uphole. The support rod 210 is still connected to the tension source uphole and so moves out of support for the tension collet 208.

Figure 8:
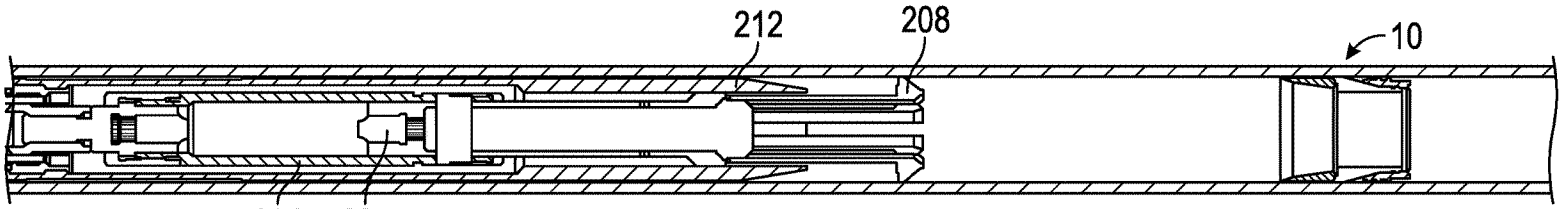

Referring to FIG. 8, once the support rod 210 is moved, the tension collet 208 will flex inwardly and release the seat assembly 10 at the target location. The running tool 200 may then be withdrawn from the hole.

Set forth below are some embodiments of the foregoing disclosure:

Embodiment 1: A seat assembly comprising a hollow frustocone; a slip subassembly interactive with the frustocone to anchor the frustocone in place during use; a seal disposed at the frustocone to receive a plug and upon receipt of the plug seal the plug to the frustocone and to a tubular structure in which the frustocone is anchored during use.

Embodiment 2: The seat assembly of embodiment 1 wherein the frustocone includes wickers at an outer frustoconical surface thereof.

Embodiment 3: The seat assembly of embodiment 1 wherein an outer surface of the frustocone is angled at a locking angle.

Embodiment 4: The seat assembly of embodiment 3 wherein the angle is less than seven degrees to an axis of the frustocone.

Embodiment 5: The seat assembly of embodiment 1 wherein the slip subassembly is a slip ring.

Embodiment 6: The seat assembly of embodiment 1 wherein the slip subassembly is a plurality of slips.

Embodiment 7: The seat assembly of embodiment 2 wherein the slip subassembly includes wicker threads complementary to the wickers of the frustocone.

Embodiment 8: The seat assembly of embodiment 1 wherein the frustocone includes a backup for the seal.

Embodiment 9: The seat assembly of embodiment 1 wherein the seal covers a seat of the frustocone.

Embodiment 10: The seat assembly of embodiment 1 wherein one or more of the frustocone and slip subassembly are configured to rapidly chemically degrade in the presence of a specific fluid.

Embodiment 11: A borehole system comprising a tubing string; a seat assembly as claimed in claim 1 disposed in the tubing string.

Embodiment 12: The borehole system of embodiment 11 wherein the seat assembly is in a set positon.

Embodiment 13: The borehole system of embodiment 11 further including a plug configured to seal with the seal.

Embodiment 14: The borehole system of embodiment 13 wherein the plug is also configured to support the frustocone.

Embodiment 15: The borehole system of embodiment 13 wherein the plug is a ball.

Embodiment 16: The borehole system of embodiment 14 wherein the plug is a body.

Embodiment 17: A method for treating a borehole comprising setting a seat assembly of embodiment 1 in a tubular structure; landing a plug in the seat assembly; and hydraulically pressuring against the plug in the seat assembly.

Embodiment 18: The method of embodiment 17 wherein the landing further includes one or more of sealing the plug to the frustocone and sealing the plug to the tubular structure.

Embodiment 19: The method of embodiment 17 wherein the landing include deforming the seal against the tubular structure.

Embodiment 20: The method of embodiment 17 wherein the landing includes supporting the frustocone with the plug.

Embodiment 21: The method of embodiment 17 wherein the pressuring includes fracturing a borehole formation surrounding the tubular structure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A seat assembly comprising:

a hollow frustocone;

a slip subassembly interactive with the frustocone to anchor the frustocone in place during use;

a seal disposed at the frustocone to receive a plug and upon receipt of the plug be disposed between the plug and the frustocone and between the plug and the tubular to seal with the plug, seal to the frustocone and seal to a tubular structure in which the frustocone is anchored during use.

2. The seat assembly as claimed in claim 1 wherein the frustocone includes wickers at an outer frustoconical surface thereof.

3. The seat assembly as claimed in claim 1 wherein an outer surface of the frustocone is angled at a locking angle.

4. The seat assembly as claimed in claim 3 wherein the angle is less than seven degrees to an axis of the frustocone.

5. The seat assembly as claimed in claim 1 wherein the slip subassembly is a slip ring.

6. The seat assembly as claimed in claim 1 wherein the slip subassembly is a plurality of slips.

7. The seat assembly as claimed in claim 2 wherein the slip subassembly includes wicker threads complementary to the wickers of the frustocone.

8. The seat assembly as claimed in claim 1 wherein the frustocone includes a backup for the seal.

9. The seat assembly as claimed in claim 1 wherein the seal covers a seat of the frustocone.

10. The seat assembly as claimed in claim 1 wherein one or more of the frustocone and slip subassembly are configured to chemically degrade in the presence of a specific fluid.

11. A borehole system comprising a tubing string;

a seat assembly as claimed in claim 1 disposed in the tubing string.

12. The borehole system as claimed in claim 11 wherein the seat assembly is in a set positon.

13. The borehole system as claimed in claim 11 further including a plug configured to seal with the seal.

14. The borehole system as claimed in claim 13 wherein the plug is also configured to support the frustocone.

15. The borehole system as claimed in claim 13 wherein the plug is a ball.

16. The borehole system as claimed in claim 14 wherein the plug is a body.

17. A method for treating a borehole comprising setting a seat assembly as claimed in claim 1 in a tubular structure;

landing a plug in the seat assembly; and hydraulically pressuring against the plug in the seat assembly.

18. The method as claimed in claim 17 wherein the landing further includes one or more of sealing the plug to the frustocone and sealing the plug to the tubular structure.

19. The method as claimed in claim 17 wherein the landing include deforming the seal against the tubular structure.

20. The method as claimed in claim 17 wherein the landing includes supporting the frustocone with the plug.

21. The method as claimed in claim 17 wherein the pressuring includes fracturing a borehole formation surrounding the tubular structure.

* * * * *